United States Patent [19]

Amdall

[11] 4,084,927

[45] Apr. 18, 1978

[54] MODIFIED HYPOTROCHOIDAL ROTARY MECHANISM

[75] Inventor: John K. Amdall, Peoria, Ill.

[73] Assignee: Caterpillar Tractor Co., Peoria, Ill.

[21] Appl. No.: 730,493

[22] Filed: Oct. 7, 1976

[51] Int. Cl.[2] ..... F01C 1/02; F01C 21/08; F01C 21/10; F02B 55/14

[52] U.S. Cl. ..... 418/61 A; 29/156.4 R

[58] Field of Search ..... 418/61 A, 150; 123/8.45; 29/156.4 R

[56] References Cited

U.S. PATENT DOCUMENTS

| | | | |
|---|---|---|---|
| 3,990,817 | 11/1976 | Ruf et al. | 418/61 A |
| 4,008,001 | 2/1977 | Tsujibayashi et al. | 418/61 A |

FOREIGN PATENT DOCUMENTS

| | | | |
|---|---|---|---|
| 1,164,746 | 3/1964 | Germany | 418/61 A |
| 583,035 | 12/1946 | United Kingdom | 418/61 A |

*Primary Examiner*—John J. Vrablik

*Attorney, Agent, or Firm*—Wegner, Stellman, McCord, Wiles & Wood

[57] ABSTRACT

A rotary mechanism including a housing having a chamber including a wall having at least one lobe having a sharp transition point thereon, a multi-nosed rotor within the chamber, a shaft having an eccentric journalling the rotor and journalled within the housing, one of the wall and the rotor periphery being generated by the clearance envelope of the other of the wall and the rotary periphery upon relative rotation of the two. The wall, in the vicinity of the lobe, is defined by a continuous curve substantially encompassing the sharp transition point. The periphery of the rotor is relieved in areas between each nose sufficiently to prevent interference between the wall and the rotor upon rotation of the rotor within the chamber.

7 Claims, 2 Drawing Figures

MODIFIED HYPOTROCHOIDAL ROTARY MECHANISM

BACKGROUND OF THE INVENTION

This invention relates to rotary mechanisms of the type having housing chambers with at least one lobe therein and wherein each lobe has a sharp transition point, and which may be employed as engines, compressors, pumps, expanders, or the like.

Prior art of possible relevance includes U.S. Pat. No. 3,323,498, issued June 6, 1967 to Kraic et al.

Rotary mechanisms having rotors within a chamber which undergo both rotational and translational motion within the chamber have lobed housings and can be characterized, in terms of their housings, as being in two categories. The first category, and the one with which the present invention concerns itself, is that type of rotary mechanism wherein the lobe or lobes within the chamber have relatively sharp transition points. The second type is comprised of those rotary mechanisms wherein the lobes are continuous curves and, consequently, do not have sharp transition points. An example, of the former type is a hypotrochoidal mechanism, while examples of the latter type include epitrochoidal mechanisms and slant axis rotary mechanisms.

In rotary mechanisms having epitrochoidal housings, typified by the "Wankel" engine, long life has been a long-sought goal. The principal difficulty in achieving the goal has been the inability to provide long lived seals, particularly apex seals in the rotor. In designing such mechanisms, the housing geometry is determinative of rotor shape with the result that the rotors have rather sharp apexes and very narrow apex seals. As a consequence, according to the present state of the art, in a typical epitrochoidal engine, sealing contact between an apex seal and the housing shifts no more than about 0.05 inches on the surface of the apex seal. The same may be said for slant axis rotary mechanisms typified by the "Clarke" engine. The confinement of sealing contact to such a small area causes rapid wear, even when exotic materials are employed in forming the seals.

Kraic et al., in their above-identified patent, propose a rotary mechanism superficially similar to epitrochoidal mechanisms, but falling in the first category of housing shapes as enumerated above. According to Kraic et al., the rotor of the mechanism is formed as a hypotrochoid and the housing geometry is that of the clearance envelope of the hypotrochoidal rotor. That is, the housing geometry is generated by the loci of points on a nose of the hypotrochoidal rotor when the same is rotated and translated in the desired fashion such that the noses of the rotor would always be in contact with the housing. In such a hypotrochoidal mechanism, the noses, corresponding to the apexes in epitrochoidal devices, or slant axis rotary mechanisms, are quite rounded and contact the housing at various points of operation over a considerably greater area than in either epitrochoidal or slant axis rotary mechanisms. As a consequence, seal wear is not confined to a small are and therefore, seal life is greatly prolonged.

However, such devices require lobed housing walls wherein the lobes have transition points that are relatively sharp, i.e., have very small radii. Thus, while following the approach will provide long lived seals, the life of the housing is shortened by reason of high contact stresses imposed upon the lobes by seals carried by the rotor. Such high contact stresses shorten the life of the housing. Specifically, because of the high contact stresses, the lubricating oil film is virtually non-existant. As a result, friction is exceedingly high and the temperature of the rubbing surface at the point of contact (the conjunction temperature) is also quite high. This causes scuffing and rapid wear resulting in housing failure.

The same difficulties attend rotary mechanisms in the first category enumerated above other than hypotrochoidal mechanisms. Consequently, the advantage of long seal life is at least in part lost due to the shortening of the life of the housing.

SUMMARY OF THE INVENTION

It is a principal object of the invention to provide a new and improved rotary mechanism of the type having a lobed chamber wherein the lobe includes a relatively sharp transition point. More specifically, it is an object of the invention to provide such a mechanism where the advantages of long seal life are retained, while the life of the housing is increased by minimizing the effect of contact stresses and conjunction temperatures at the lobes of such a mechanism.

An exemplary embodiment of the invention achieves the foregoing object in a rotary mechanism having a housing with a chamber including a wall. The wall has at least one lobe having a sharp transition point thereon. A multi-nosed rotor is disposed within the chamber and a shaft having an eccentric journals the rotor and is journalled within the housing. The mechanism is of the type wherein one of the wall and the rotor periphery is generated by the clearance envelope of the other of the wall and the rotor periphery upon relative rotation and translation of the two. The improved mechanism, in the vicinity of the lobe or lobes contemplates the provision, in the wall, of a continuous curve substantially encompassing the sharp transition point. The periphery of the rotor is relieved in areas between each nose sufficiently to prevent interference between the wall and the rotor upon rotation and translation of the rotor within the chamber.

In the preferred embodiment, the rotary mechanism is a hypotrochoidal mechanism and the shape of the rotor is modified from that of a true hypotrochoid. The invention contemplates a structure wherein the housing has an internal lobed surface defined by the clearance envelope of the rotor. The improved mechanism provides that the internal surface of the housing be located inwardly of the envelope at least immediately adjacent the lobe to provide a gentle curve at the lobe or lobes. The peripheral surface of the rotor is relieved in areas between each nose to avoid interference as mentioned above. Because of the provision of a gentle curve at the lobes, contact stresses and conjunction temperatures in excess of those desired do not occur thereby extending the life of the housing. At the same time, the retention of a generally hypotrochoidal, albeit modified, shape of the rotor provides the advantages of wide seals, prolonging seal life.

In a highly preferred embodiment of the invention, the gentle curve at the lobe has a curvature on the order of that of the peripheral surface of the rotor at each nose. The peripheral surface of the rotor is relieved at areas which terminate short of the midpoint of the peripheral surface between the noses.

The gentle curve at the lobe or lobes is selected to have a radius sufficiently large to prevent the existence of high contact stresses and conjunction temperatures and may be circular, hyperbolic, parabolic, elliptical, or the like.

In a preferred embodiment, the peripheral surface of the rotor has three noses and the internal surface of the housing has two lobes.

Other objects and advantages of the invention will become apparent from the following specification taken in connection with the accompanying drawings.

DESCRIPTION OF THE PRIOR ART

Figure 1:
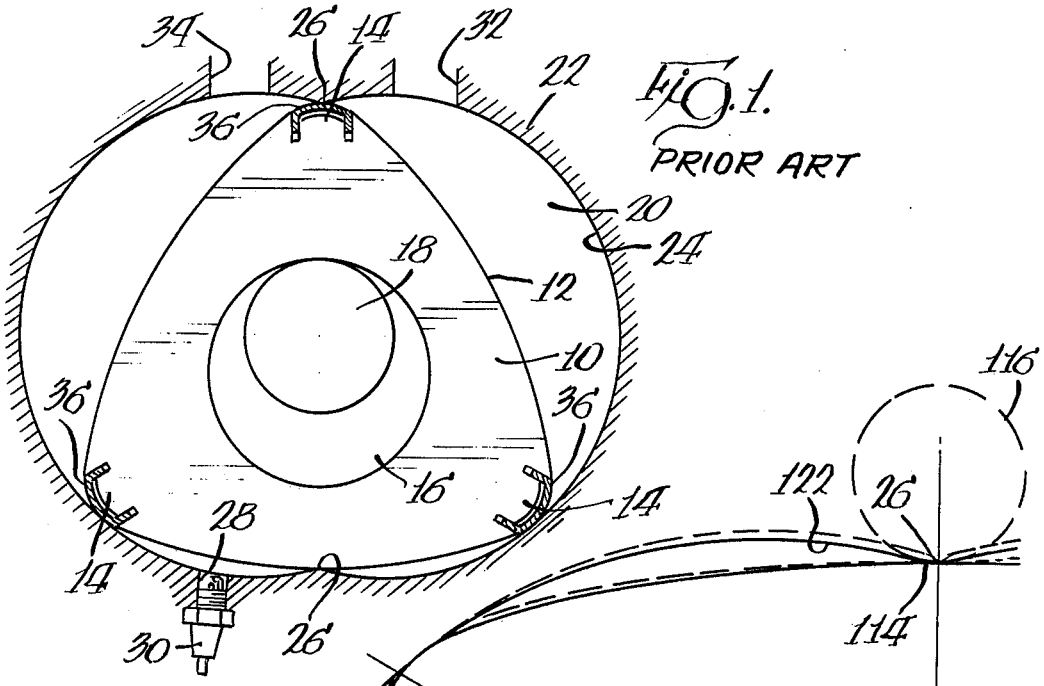
Fig. 1. PRIOR ART
FIG. 1 is a sectional view of a hypotrochoidal rotary engine made according to the prior art.

A typical prior art hypotrochoidal mechanism is illustrated in FIG. 1 in the form of a four-cycle spark ignition engine. The same includes a rotor 10 having a peripheral surface 12 formed as a hypotrochoid with three, equally spaced noses 14 thereon. The rotor 10 is journalled on an eccentric 16 formed on a shaft 18 which, in turn, is journalled by any suitable means (not shown) in end housings 20. The mechanism also includes a center housing 22 having an internal surface 24 which is determined by areas extending to both sides of and including the center of any one of the noses 14 when the shaft and rotor are relatively rotated at the desired ratio, for example, in a mechanism of the type illustrated in FIG. 1, one revolution of the rotor 10 for each three revolutions of the shaft 18. As a consequence, the surface 24 will be substantially discontinuous at the waist, as illustrated at points 26. That is, the points 26 will be sharp transition points having extremely small radii.

The center housing 22 includes a bore 28 for receipt of a spark plug 30 as well as an intake port 32 and an exhaust port 34.

Lastly, each of the noses 14 of the rotor 10 carries relatively wide apex seals 36 and, as can be seen by comparing the point of contact of the lower right-hand seal 36 with the surface 24 and the point of contact of the lower left-hand seal 36, the contact there shifts a substantial distance at varying points during the cycle so that extremely good seal life results. However, because of the presence of the transition points 26 in the surface 24, high contact stresses will exist at such points and lead to a premature failure of the housing thereat. In addition, there will be undesirably high conjunction temperatures thereat.

DESCRIPTION OF THE PREFERRED EMBODIMENT

A preferred embodiment of a rotary mechanism made according to the invention is in the form of a generally hypotrochoidal mechanism. However, it is to be understood that the invention is not limited to hypotrochoidal rotary mechanisms, but rather, may be usefully employed in other types of rotary mechanisms wherein the rotor undergoes relative rotation and translation within a housing having one or more lobes with each of the lobes having a relatively sharp transition point. For purposes of the invention, a sharp transition point may be defined as a discontinuous curve or a continuous curve having a very small radius. In the case of the latter, because the size of mechanism housings differ according to desired output and because, even for engines with identical housing configurations but with differing design lives, rated speeds, surface hardness, or the like, it is impossible to define, in absolute terms of measurement, a "relatively small radius". However, those skilled in the art will readily recognize that a relatively small radius will be that wherein undesirably high contact stresses and/or conjunction temperatures will occur for the particular housing size, the particular rated speed, the composition of the housing surface and seals and will result in premature housing failure measured by the intended design life of the mechanism.

Figure 2:
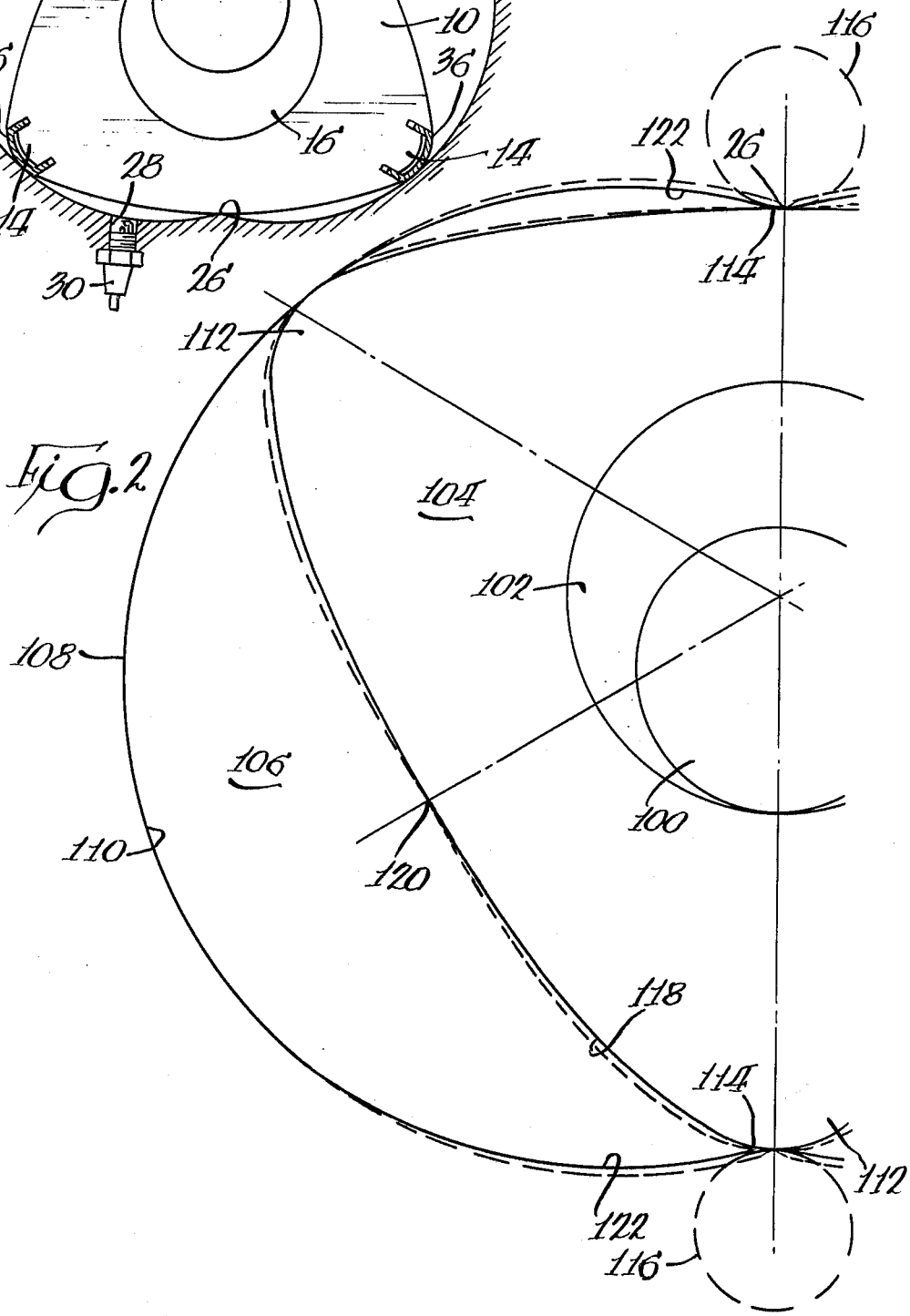
FIG. 2 is a fragmentary, enlarged view of a hypotrochoidal rotary mechanism made according to the invention with the construction of a prior art mechanism superimposed thereon in dotted lines.

Turning now to FIG. 2, there is seen a rotary mechanism made according to the invention in the form of a modified hypotrochoidal mechanism. The inventive mechanism is shown in solid line form, albeit somewhat schematically, and the outline of the prior art counterparts of the components is shown in dotted lines.

The mechanism includes a shaft 100 with an eccentric 102 thereon which journals a rotor 104 for movement within a chamber 106 defined by a housing 108. The housing 108 includes an internal surface 110 which is sealingly engaged by apex seals (not shown) carried by each of three noses 112 on the rotor 104. The internal surface 110 has two lobes 114 defining a waist. However, it is to be understood that the invention is applicable in hypotrochoidal mechanisms having a few as one lobe on the interior surface 110.

As can be seen in FIG. 2, at each lobe 114, there exists a gentle curve rather than an abrupt transition point such as the transition point 26. The gentle curve at each lobe 114 may be part of a circle, an ellipse, a parabola, a hyperbola, or the like. As illustrated in FIG. 2, it is part of a circle shown in dotted lines at 116 whose radius is sufficient that high contact stesses in excess of a predetermined amount will not exist. The amount of contact stress that can be tolerated will depend upon the intended life of the mechanism as well as the materials used, etc., and can be determined according to conventional engineering techniques. The gentle curve defined by each of the circles 116 encompasses the transition point 26 of the original housing in dotted lines in FIG. 2.

With the gentle curve at each lobe 114 determined, the rotor peripheral surface 118 is relieved from the basic hypotrochoidal configuration in areas between each nose 112 to the midpoint of the relatively flat faces between the noses 112. The relief is such that the rotor 104 may rotate within the chamber 106 without interference at the lobes 114.

The internal surface 110 of the housing 108 is located inwardly of the envelope determined by the true hypotrochoid on each side of each lobe 114 as shown, for example, at 122. The particular location is chosen such that the apex seals (not shown) on each of the noses 112 will always be in sealing contact with the surface 110 with a minimum of radial movement.

In a highly preferred embodiment, the radius of the gentle curve at each lobe 114 is on the order of the radius generating the curve of each nose 112, it being understood that in either case, the surfaces need not be truly circular so as to have a fixed radius. In other words, it is desirable that the curve at each lobe 114 be similar to the curve on the noses 112.

It will be appreciated that in a hypotrochoidal mechanism made according to the invention, the noses 112 are slightly narrowed as compared to noses on an unmodified hypotrochoidal rotor. However, it will also be appreciated that the deviation in the vicinity of the noses 112 is so small that seals having a width considerably greater than that employed in seals in epitrochoidal or slant axis rotary mechanisms will be required.

Thus, the invention allows the use of wide seals having a large contact area, thereby promoting long life of the seals. At the same time, by means of the invention, high contact stresses and conjunction temperatures at the lobes of the housing are eliminated so that a long-lived housing also results.

As a consquence of the foregoing, it is possible to fabricate, for example, an engine employing the principles of the invention that will rate as a so-called "heavy duty" engine, whereas epitrochoidal engines thus far produced, at best, can only achieve a medium duty rating.

It will also be appreciated that rotary mechanisms made according to the invention may be advantageously employed in multiple-stage engine or compressor or expander configurations and, when used as engines, may be turbocharged as well.

Finally, those skilled in the art will recognize that in non-engine uses as, for example, use as a pump, seals can be employed at the lobes of the housing, the contact surface of such seals configured identically to that of the housing in the vicinity of the lobes as described above and illustrated in the drawings herein.

What is claimed is:

1. In a hypotrochoidal rotary mechanism including a multi-nosed rotor having a generally hypotrochoidal peripheral surface, a shaft having an eccentric journalling the rotor, and a housing defining a chamber receiving the rotor and journalling the shaft and having an internal, lobed surface having an envelope determined by the locus of a nose on the peripheral surface of the rotor for a predetermined relative rotation ratio of the rotor, the shaft and the housing, the improvement wherein the said internal surface is nonparallel to and located inwardly of said envelope immediately adjacent and to either side of the lobe(s) to provide a gentle, continuous curve at the lobe(s) and wherein said peripheral surface is relieved in areas between each nose sufficiently to prevent interference between said surfaces upon rotation of said rotor within said chamber.

2. The hypotrochoidal rotary mechanism of claim 1 wherein said gentle curve has a curvature similar to that of said peripheral surface at each nose.

3. The hypotrochoidal rotary mechanism of claim 1 wherein said gentle curve has a radius sufficiently large to prevent the existence of high contact stesses at said lobe(s).

4. In a hypotrochoidal rotary mechanism including a multi-nosed rotor having a generally hypotrochoidal peripheral surface, a shaft having an eccentric journalling the rotor, and a housing defining a chamber receiving the rotor and journalling the shaft and having an internal, lobed surface having an envelope determined by the locus of a nose on the peripheral surface of the rotor for a predetermined relative rotation ratio of the motor, the shaft and the housing, the improvement wherein the said internal surface is nonparallel to and located inwardly of said envelope at least immediately adjacent the lobe(s) to provide a gentle, continuous curve at the lobe(s) and wherein said peripheral surface is relieved in areas between each nose sufficiently to prevent interference between said surfaces upon rotation of said rotor within said chamber; said peripheral surface relieved areas terminating short of the midpoint of the peripheral surface between noses.

5. In a hypotrochoidal rotary mechanism including a multi-nosed rotor having a generally hypotrochoidal peripheral surface, a shaft having an eccentric journalling the rotor, and a housing defining a chamber receiving the rotor and journalling the shaft and having an internal, lobed surface having an envelope determined by the locus of a nose on the peripheral surface of the rotor for a predetermined relative rotation ratio of the rotor, the shaft and the housing, the improvement wherein said internal surface at the lobe(s) has a gentle, continuous curve with a radius sufficiently great to prevent the occurrence of contact stresses thereat greater than a predetermined amount, said peripheral surface includes reliefs sufficient to allow relative rotation of said rotor and housing without interference at said lobe(s), and said internal surface is located inwardly of said envelope to either side of said lobe(s) and nonparallel to said envelope.

6. In a hypotrochoidal rotary mechanism including a multi-nosed rotor having a generally hypotrochoidal peripheral surface, a shaft having an eccentric journalling the rotor, and a housing defining a chamber receiving the rotor and journalling the shaft and having an internal, lobed surface having an envelope with a sharp transition point at said lobe(s) and determined by the locus of a nose on the peripheral surface of the rotor for a predetermined relative rotation ratio of the rotor, the shaft and the housing, the improvement wherein said internal surface at the lobe(s) has a gentle, continuous curve extending through said shart transition point and with a radius sufficiently great to prevent the occurrence of contact stresses thereat greater than a predetermined amount, said peripheral surface including reliefs sufficient to allow relative rotation of said rotor and housing without interference at said lobe(s), and said internal surface being located inwardly of said envelope to either side of said lobe(s) and nonparallel to said envelope.

7. A method of making a rotary mechanism comprising: selecting a theoretical rotor peipheral shape in the form of a desired hypotrochoid; determining the clearance envelope of the rotor shape by rotating and translating the rotor shape in a predetermined manner such that said clearance envelope has at least one lobe thereon; altering the clearance envelope to either side of each lobe by locating the envelope nonparallel to and inwardly of said clearance envelope to provide a gentle, continuous curve at each lobe thereon; fabricating a mechanism housing having a wall configured in the shape of said altered clearance envelope; relieving the rotor shape so that the same will clear said altered clearance envelope when rotated in said predetermined manner; fabricating a rotor having a periphery following that of said relieved rotor shape; and assembling said rotor to said housing to form a rotary mechanism.

* * * * *

UNITED STATES PATENT AND TRADEMARK OFFICE

CERTIFICATE OF CORRECTION

PATENT NO. : 4,084,927

DATED : April 18, 1978

INVENTOR(S) : JOHN K. AMDALL

It is certified that error appears in the above-identified patent and that said Letters Patent are hereby corrected as shown below:

Column 3, lines 62 and 63, change "witnhin" to --within--.

Column 4, line 27, change "a" to --as--.

Column 6, line 37, change "shart" to --sharp--.

Column 6, line 47, change "peipheral" to --peripheral--.

Signed and Sealed this

*Twenty-first* Day of *November 1978*

[SEAL]

*Attest:*

RUTH C. MASON
*Attesting Officer*

DONALD W. BANNER
*Commissioner of Patents and Trademarks*